US012297820B2

(12) United States Patent
Wen

(10) Patent No.: US 12,297,820 B2
(45) Date of Patent: May 13, 2025

(54) PORTABLE ELECTRIC INFLATOR

(71) Applicant: Shenzhen Fanttik Technology Innovation Co., Ltd., Shenzhen (CN)

(72) Inventor: Mingrong Wen, Shenzhen (CN)

(73) Assignee: SHENZHEN FANTTIK TECHNOLOGY INNOVATION CO., LTD., Shenzhen (CN)

( * ) Notice: Subject to any disclaimer, the term of this patent is extended or adjusted under 35 U.S.C. 154(b) by 286 days.

(21) Appl. No.: 18/139,306

(22) Filed: Apr. 25, 2023

(65) Prior Publication Data

US 2024/0360819 A1 Oct. 31, 2024

(51) Int. Cl.

| | |
|---|---|
| ***F04B 35/04*** | (2006.01) |
| ***F04B 35/06*** | (2006.01) |
| ***F04B 39/00*** | (2006.01) |
| ***F04B 39/06*** | (2006.01) |
| ***F04B 39/12*** | (2006.01) |

(52) U.S. Cl.
CPC ..... *F04B 35/04* (2013.01); *F04B 35/06* (2013.01); *F04B 39/0044* (2013.01); *F04B 39/066* (2013.01); *F04B 39/12* (2013.01)

(58) Field of Classification Search
CPC ..... F04B 35/04; F04B 35/06; F04B 39/121; F04B 39/12; F04B 17/03; F04B 49/06; F04B 39/0044
See application file for complete search history.

(56) References Cited

U.S. PATENT DOCUMENTS 4,789,310 A * 12/1988 Hung ..... F21V 33/0088 417/313
5,127,808 A * 7/1992 Nichols ..... B62J 11/02 417/234
10,598,165 B2 * 3/2020 Wang ..... F04B 17/03
(Continued)

FOREIGN PATENT DOCUMENTS

CN 112727731 A * 4/2021
CN 113669226 A * 11/2021 ..... F04B 35/04
(Continued)

OTHER PUBLICATIONS

"Fanttik X8 APEX Tire Inflator," web page <https://fanttik.com/products/x8-apex-tire-inflator>, 10 pages, Mar. 13, 2022, retrieved from internet Archive Wayback Machine <https://web.archive.org/web/20220315000000*/https://fanttik.com/products/x8-apex-tire-inflator> Apr. 1, 2025 (Year: 2022).*

*Primary Examiner* — Dominick L Plakkoottam

(57) ABSTRACT

A portable electric inflator includes: a housing comprising an upper end, a lower end, and a receiving chamber that extends from the upper end to the lower end; an air compressor including a motor, a transmitting mechanism, and a pump that are received in the receiving chamber and sequentially arranged in an order from the upper end to the lower end, wherein a receiving space is formed between the pump and the housing; a battery assembly arranged in the receiving chamber, the battery assembly including: a battery retainer received in the receiving space; at least two battery cells arranged side by side in the battery retainer; a support member extending from one end of the battery retainer adjacent to the lower end, the support member perpendicular to a lengthwise direction of the battery retainer; and a circuit board fixed to the support member.

10 Claims, 14 Drawing Sheets

(56) References Cited

U.S. PATENT DOCUMENTS

| | | | | |
|---|---|---|---|---|
| 10,731,637 | B2 * | 8/2020 | Walmsley | F04B 35/06 |
| 2004/0115073 | A1 * | 6/2004 | Lin | F04B 35/04<br>417/415 |
| 2006/0013709 | A1 * | 1/2006 | Hudson | F04B 17/03<br>417/234 |
| 2015/0322935 | A1 * | 11/2015 | Wang | F04B 33/005<br>417/415 |
| 2019/0120216 | A1 * | 4/2019 | Wang | F04B 35/01 |
| 2019/0183099 | A1 * | 6/2019 | Lin | F04D 13/068 |
| 2025/0101973 | A1 * | 3/2025 | Wu | F04B 39/121 |

FOREIGN PATENT DOCUMENTS

| | | | | |
|---|---|---|---|---|
| CN | 115479005 | A | * | 12/2022 |
| CN | 219911063 | U | * | 10/2023 |

* cited by examiner

PORTABLE ELECTRIC INFLATOR

TECHNICAL FIELD

The present disclosure generally relates to inflators, and particularly to a portable electric inflator.

BACKGROUND

Inflators have been widely used in people's lives, and they can be used to inflate tires of automobiles, motorcycles, and bicycles, rubber balls, and rubber boats, etc. Many electric inflators use the rotary motion of a motor to drive a piston to reciprocate in a cylinder and compress the air in the cylinder to achieve the purpose of inflation.

Some conventional inflators on the market are too large in size, not compact enough in structure, and inconvenient to carry and store. In addition, the bottom of some conventional inflators on the market is not designed with anti-shock feature. When the inflators are placed on the ground, vibration and friction noise is large, which is easy to cause wear on the bottom of the inflator. Although the bottom of some inflators has an anti-shock pad, most of the anti-shock pads are glued to the bottom of the inflators. That is, the anti-shock pads and the inflators are not of integral design. The disadvantage of this structure is that the firmness of the anti-shock pads and the inflators depend entirely on the viscosity of the adhesives on the anti-shock pads. There is a risk that the anti-shock pads may fall off when the adhesives on the anti-shock pads are usually exposed to dust or rain water.

Therefore, there is a need to provide a portable electric inflator to overcome the above-mentioned problem.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
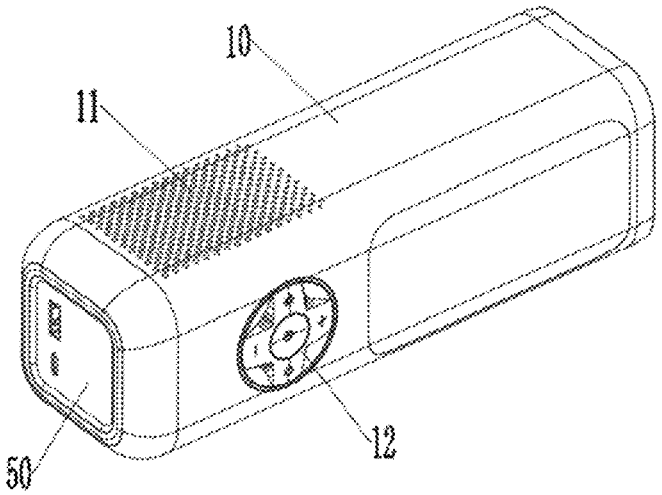
FIG. 1 is an exemplary isometric view of a portable electric inflator according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 5:
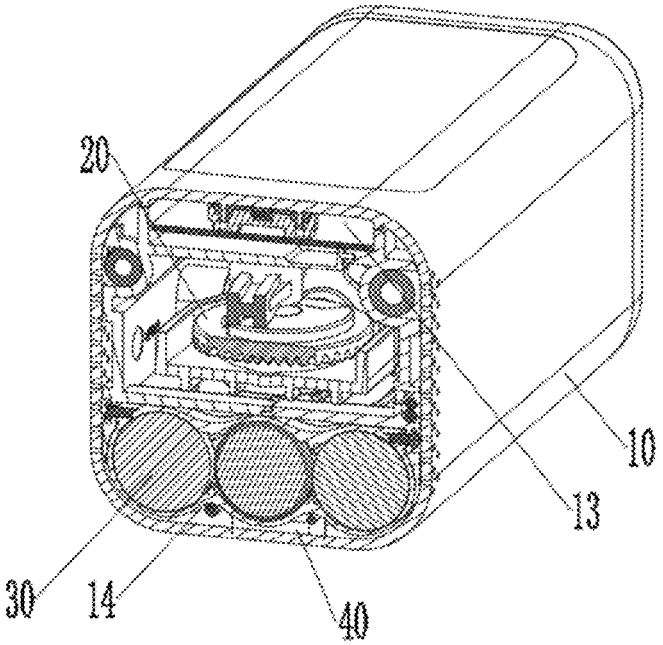
FIG. 5 is an isometric sectional view of the portable electric inflator.
Figure 8:
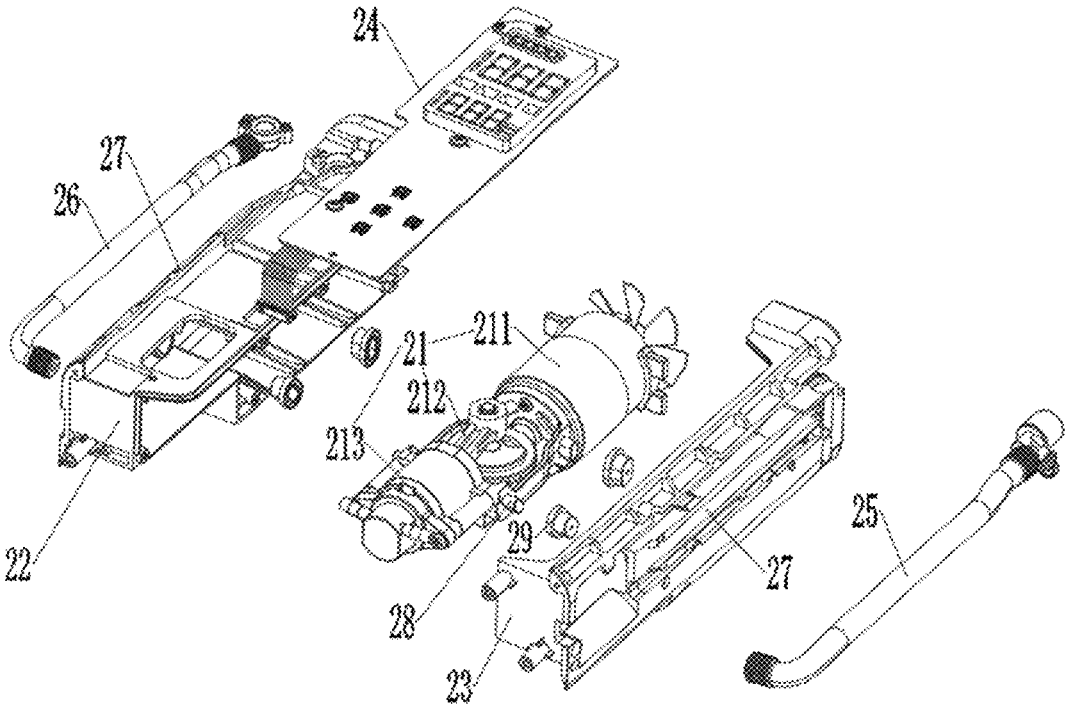
FIG. 8 is an exploded view of the compressor of the portable electric inflator.

Referring to FIGS. 1-4, in one embodiment, a portable electric inflator may include a housing 10, an air compressor 20, and a battery assembly 30. The housing 10 may include an upper end 101, a lower end 102, and a receiving chamber 13 (see FIG. 5) that extends from the upper end 101 to the lower end 102. Referring to FIG. 8, the air compressor 20 may include a compressor body 21 that comprises a motor 211, a transmitting mechanism 212, and a pump 213 that are received in the receiving chamber 13 and sequentially arranged in an order from the upper end 101 to the lower end 102. A receiving space 40 is formed between the pump 213 and the housing 10.

Figure 6:
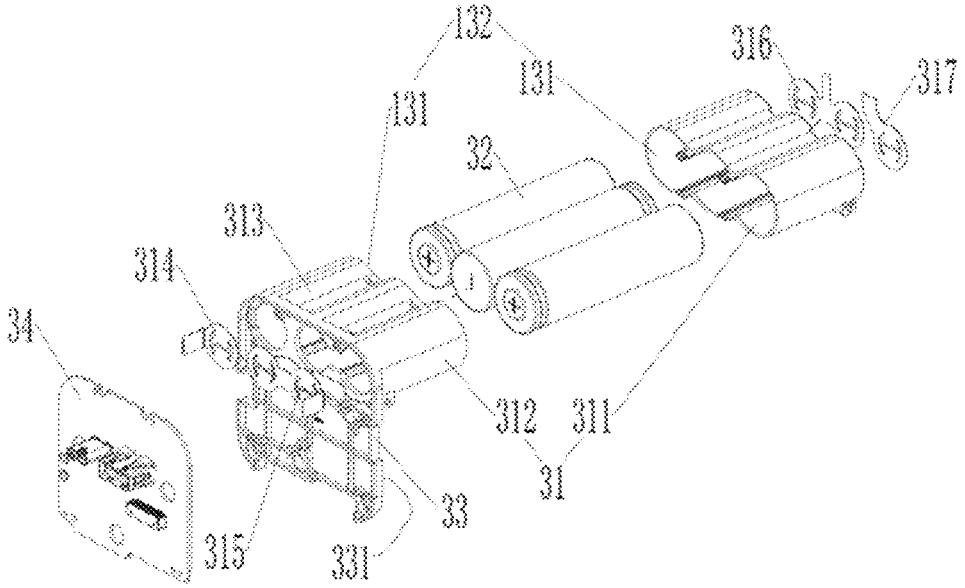
FIG. 6 is an exploded view of a battery assembly of the portable electric inflator.

The battery assembly 30 is arranged in the receiving chamber 13 near the lower end 102. Referring to FIG. 6, in one embodiment, the battery assembly 30 may include a battery retainer 31, at least two battery cells 32, a support member 33, and a circuit board 34. The battery retainer 31 is received in the receiving space 40. The at least two battery cells 32 are arranged side by side in the battery retainer 31. The support member 33 extends from one end of the battery retainer 31 adjacent to the lower end 102. The support member 33 is substantially perpendicular to a lengthwise direction of the battery retainer 31. The circuit board 34 is fixed to the support member 33 and electrically connected with the at least two battery cells 32.

The compressor 20 is to inflate an object to be inflated, such as tires of automobiles, motorcycles, and bicycles, rubber balls, and rubber boats. The battery assembly 30 is electrically connected with the compressor 20 and is to power the compressor 20, so that no additional external power supply is needed for the inflator, so as to improve the portability of the inflator.

The battery retainer 31 is substantially perpendicular to the support member 33. In one embodiment, the battery retainer 31 protrudes from one side surface 331 of the support member 33. The support member 33 and the battery retainer 31 form an L-shaped structure. The circuit board 34 is fixed to the side surface of the support member 33 away from the compressor 20 and is electrically coupled with the battery cells 32. The circuit board 34 covers the side surface of the base support member 33, and the support member 33 covers one end of the compressor 20.

In one embodiment, a recessed portion is formed in the compressor assembly 20, and the recessed portion can be located on one side of the pump 213. A space (i.e., receiving space 40) is formed between the recessed portion and the inner surface of the housing 10. The L-shaped battery assembly 30 can be received in the receiving space 40. In this way, the battery assembly 30 occupies a small space, which makes full use of the inner space in the housing 10, thereby improving the compactness of the inflator, reducing the size of the inflator, and facilitating storage and portability.

In one embodiment, the battery assembly 30 can be pre-assembled with the compressor 20 to form a cuboid structure that can be directly inserted into the housing 10.

Referring to FIG. 6, in one embodiment, the battery retainer 31 may include a first retainer 311 and a second retainer 312 that are connected to each other. The second retainer 312 is perpendicularly connected to the support member 33. Each of the first retainer 311 and the second retainer 312 is hollow. In one embodiment, the first retainer 311 and a second retainer 312 face each other and each define a number of half chambers 131. Each of the half chambers 131 has two opposite open ends. When the first retainer 311 and a second retainer 312 are connected to each other, the half chambers 131 constitute a number of battery receiving chambers 132. In one embodiment, the number of the battery cells 32 is three and the number of the battery receiving chambers 132 is three. A first half and a second half of each battery cell 32 are respectively received in a corresponding first half chamber 132 of the first retainer 311 and a corresponding second half chamber 132 of the second retainer 312. By designing the battery receiving chambers 132 in the manner above, it is convenient to insert the battery cells 32 into the battery receiving chambers 132, and it is convenient to remove the battery cells 32 from the battery receiving chambers 132.

In one embodiment, the first retainer 311 and the second retainer 312 may be connected to each other by snap-fit connection, which is not limited here. For example, a number of openings are arranged at one end of the second retainer 312 adjacent to the first retainer 311, and a number of books are arranged at one end of the first retainer 311 adjacent to the second retainer 312. The hooks are shaped and arranged corresponding to the openings and snap into the openings, respectively, which connects the first retainer 311 to the second retainer 312.

In one embodiment, elongated protrusions can be arranged between two adjacent half chambers 131 for partition, so as to prevent the battery cells 32 in one battery receiving chambers 312 from moving into neighboring battery receiving chamber(s) 132. In addition, it can also avoid that two adjacent battery cells 32 tightly abut against each other, which affects heat dissipation.

It should be noted that the present disclosure does not limit the length of the half chambers 131 of the second retainer 312 and the first retainer 311. In other words, the lengths of the half chambers 131 of the second retainer 312 and the first retainer 311 may be the same or different.

In one embodiment, the battery receiving chambers 132 extend along a lengthwise direction of the housing 10. The battery receiving chambers 132 are parallel to one another. A guide groove 313 is formed in an external surface of the battery retainer 31 between each two adjacent battery receiving chambers 132. One or more guide ridges 14 protrude from an inner surface of the housing 10. The one or more guide ridges 14 are fit in the guide grooves 313, and slide along the guide grooves 313 when the battery retainer 31 is inserted into the receiving space 40.

Since there is a space between two adjacent battery cells 32, a guide groove 313 arranged between two adjacent battery cells 32 is not only conducive to separating two adjacent battery cells 32, but also conducive to the insertion of the battery assembly 30 and the compressor 20 into the housing 10. That is, the engagement of the guide grooves 313 and the guide ridges 14 guides the battery assembly 30 and the compressor 20 such that they can be easily inserted into the housing 10. In addition, the engagement of the guide grooves 313 and the guide ridges 14 can prevent the compressor 20 from unintentional movement in the housing 10. In one embodiment, the guide ridges 14 on the inner surface of the housing 10 can be designed to be elongated, which adapts to the guide grooves 313

The number of the battery receiving chambers 132 can be determined according to the number of the battery cells 32, and the number of the battery cells 32 can be determined according the battery capacity or power requirement of the inflator, which is not limited here. In one embodiment, there are three battery receiving chambers 132 and three battery cells 32, and the three battery cells 32 are arranged side by side in the three battery receiving chambers 132. It should be noted that the present disclosure does not impose any limitation on the arrangement of the battery cells 32, which can be adjusted according to actual needs.

In one embodiment, after the battery assembly 30 and the compressor 20 are assembled and inserted into the housing 10 as a whole, the compressor 20 and the housing 10 can be connected to each other by a number of fasteners (e.g., screws) to ensure the mounting stability of the compressor 20.

Referring to FIG. 6, in one embodiment, a positive electrode nickel sheet 314 and a first connecting nickel sheet 315 are soldered to one end of the second retainer 312 that penetrates the support member 33. A negative electrode nickel sheet 316 and a second connecting nickel sheet 317 are soldered to one end of first retainer 311. The three battery cells 32 are connected to one another in series through the positive nickel sheet 314, the negative nickel sheet 316, the first connecting nickel sheet 315 and the second connecting nickel sheet 317. A charging port is arranged on the circuit board 34, and the charging port is electrically connected to the positive nickel sheet 314 so as to charge the battery cell unit 32.

Figure 7:
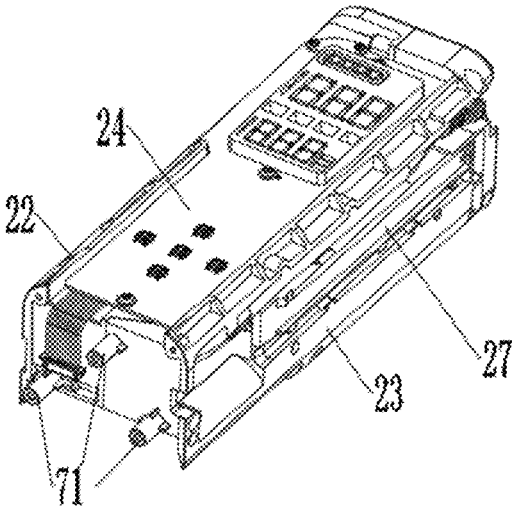
FIG. 7 is an isometric view of the compressor of the portable electric inflator.

Referring to FIGS. 7 and 8, in one embodiment, the air compressor 20 further includes a first casing 22, a second casing 23, a control circuit board 24, a discharge hose 25, and a sensor hose 26. The compressor body 21 is arranged between the first casing 22 and the second casing 23 that are connected to each other. The first casing 22 and the second casing 23 each define an accommodating groove 27 for respectively receiving the sensor hose 26 and the discharge hose 25. The sensor hose 26 and the discharge hose 25 are connected with the pump 213 of the compressor body 21, and the control board 24 is fixed to the first casing 22.

In the embodiment, the first casing 22 and the second casing 23 are locked together to accommodate the compressor body 21 therein. An air vent is provided in the first casing 21. The motor 211, the transmission mechanism 212 and the pump 213 are installed in the compressor body 21 from top to bottom. A fan is also installed on the top of the output shaft of the motor 211. Both the upper end and the lower end of the housing 10 are provided with openings, and the lower end of the housing 10 is provided with a shock absorbing end cover 50. A top cover 60 with a hollow structure is arranged on the upper end of the housing 10, and a number of ventilation holes 11 are defined in the side surface of the housing 10 adjacent to the lower end. During the operation of the inflator, the motor 211 drives the pump 213 and also drives the fan to rotate, so that the outside air enters the housing 10 through the vent holes 11 under the guidance of the fan, and enters the space between the first casing 22 and the second casing 23 through the air vent. The inner space formed by the right bracket 23 cools the pump 213 and the motor 211 and discharges them from the hollow of the top cover 60, which effectively improves the cooling effect of the inflator. After cooling the pump 213 and the motor 211, the air is discharged from the hollow space of the top cover 60, which effectively improves the cooling effect of the inflator.

In one embodiment, the bottom end of the pump 213 is connected to the discharge hose 25 and the sensor hose 26 through a three-way valve. The discharge hose 25 is to connect with to-be-inflated objects (e.g., tires), and the sensor hose 26 is to monitor the inflation pressure of the inflator.

In one embodiment, the control circuit board 24 is electrically connected with the compressor body 21 to control the working state of the compressor body 21.

In one embodiment, a number of buttons 12 (see FIG. 1) is arranged on the housing 10 so as to receive user operations and actuate switches arranged on the control circuit board 24. In one embodiment, the buttons 12 are sized and arranged according to the switches on the control circuit board 24, which is not limited here.

In one embodiment, the first casing 22 and the second casing 23 are connected to each other by fasteners (e.g., screws), and the control circuit board 24 can also be connected with the first casing 22 by screws, which is not limited here.

During assembly, the compressor body 21 is placed between the first casing 22 and the second casing 23, and the first casing 22 and the second casing 23 are then connected to each other by screws. Then, the sensor hose 26 and discharge hose 25 are respectively placed in the accommodating grooves of the first casing 22 and the second casing 23 and are connected with compressor body 21. Finally, the control circuit board 24 is fixed to the first casing 22 by screws.

Figure 9:
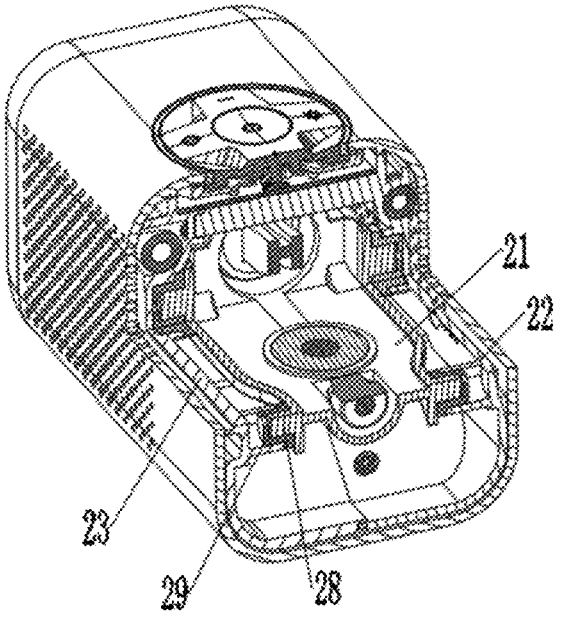
FIG. 9 is another isometric sectional view of the portable electric inflator.

Referring to FIGS. 8 and 9, in one embodiment, the compressor body 21 may include a number of protruding posts 28 that are inserted into the first casing 22 and the second casing 23, and the protruding posts 28 are covered with shock absorbing pads 29.

The present disclosure does not impose any limitation on the number of the protruding posts 28. In the present embodiment, the number of the protruding posts 28 is four and they are respectively arranged on the opposite sides of the compressor body 21. The first casing 22 and the second casing 23 each define two insertion holes, and the protruding posts 28 are inserted into the insertion holes, respectively. Correspondingly, there are four shock absorbing pads 29 which are respectively arranged around the outer surfaces of the four protruding posts 28.

Figure 3:
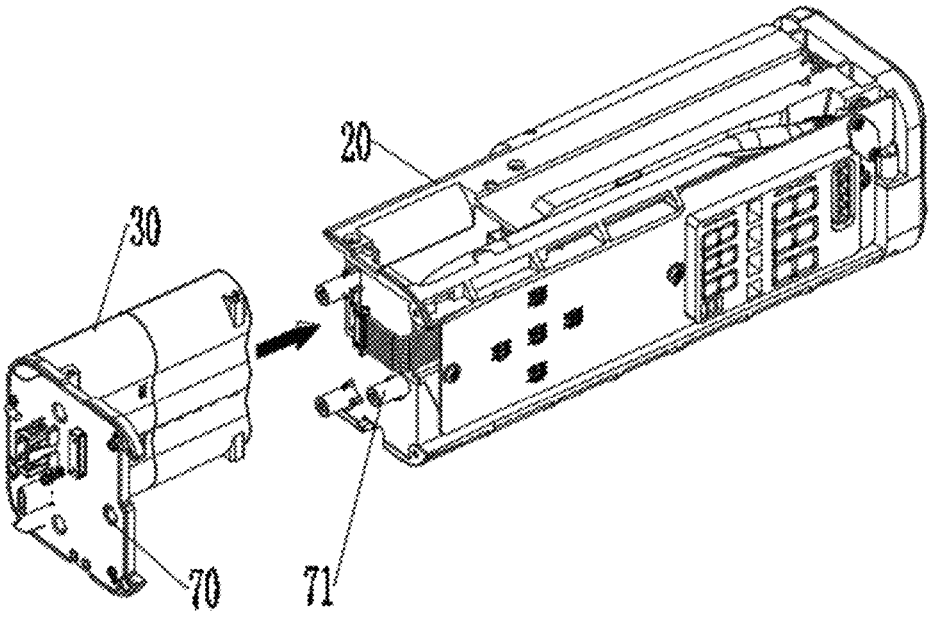
FIG. 3 is an exploded view of an assembly including a compressor and a battery assembly of the portable electric inflator.
Figure 4:
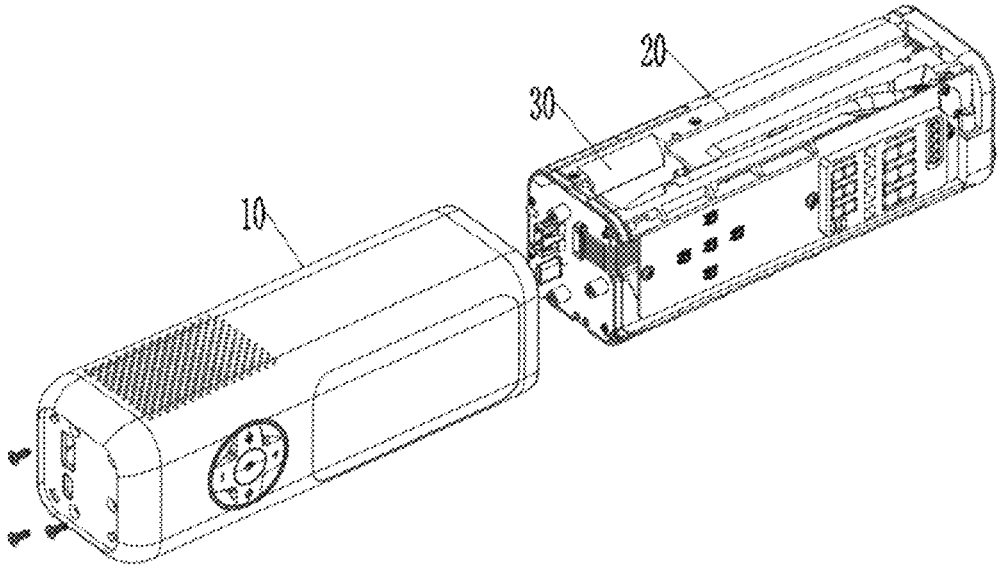
FIG. 4 is another exploded view of the portable electric inflator according to one embodiment.

Referring to FIG. 3, in one embodiment, the support member 33 defines a number of positioning holes 70, and a number of positioning posts 71 are arranged on the first casing 22 and the second casing 23. The positioning holes 70 correspond to the positioning posts 71 one by one, and the positioning posts 71 are inserted into the corresponding positioning holes 70 when the support member 33 is connected to the first casing 22 and the second casing 23. The positioning holes 70 cooperate with the positioning posts 71, which is used for positioning and guiding during the connection of the battery assembly 30 with the first casing 22 and the second casing 23, thereby ensuring that the battery retainer 31 can abut against the second casing 23 and the inner surface of the housing 10, and ensuring the compactness of the overall structure of the inflator.

In one embodiment, the positioning posts 71 is configured in one of the following manners that allows the battery retainer 31 to be inserted into the receiving space 40 only in a predetermined angle: each of the of positioning posts 71 has an irregular cross section; the cross sections of the positioning posts 71 are different in size; and the cross sections of the positioning posts 71 are different in shape.

In one embodiment, after the positioning posts 71 are inserted into the positioning holes 70, the end surface of the positioning posts 71 are flush with the end surface of the support member 33.

In one embodiment, the number of positioning holes 70 is three, and the three positioning holes 70 are not arranged along a straight line, but generally distributed in an imaginary triangular, so that the guiding and positioning effect is better.

In one embodiment, the circuit board 34 can be connected with the support member 33 by screws, and the support member 33 can be connected with the first casing 22 and the second casing by screws, which is not limited here.

Figure 10:
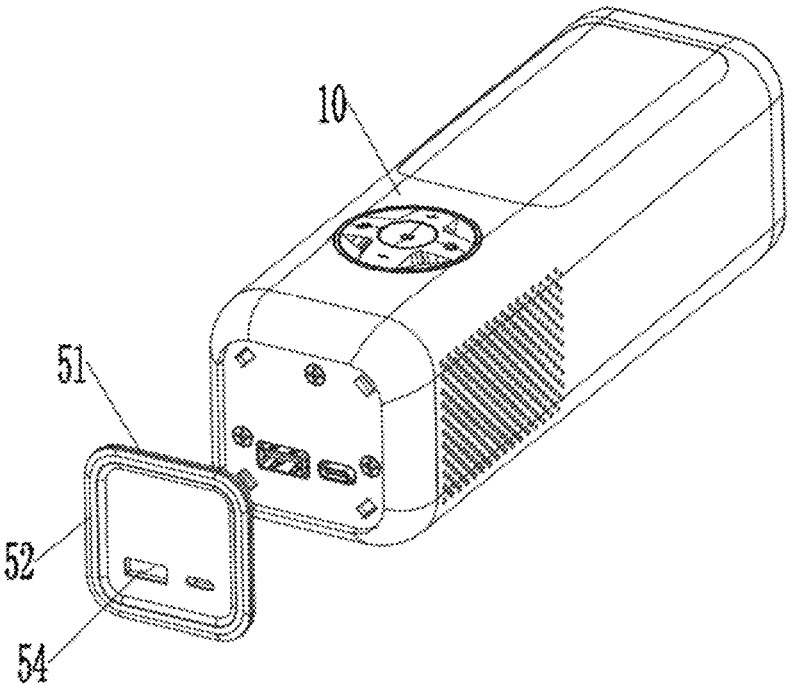
FIG. 10 is an exploded view of the portable electric inflator, showing a shock absorbing end cover detached from the housing of the portable electric inflator.
Figure 12:
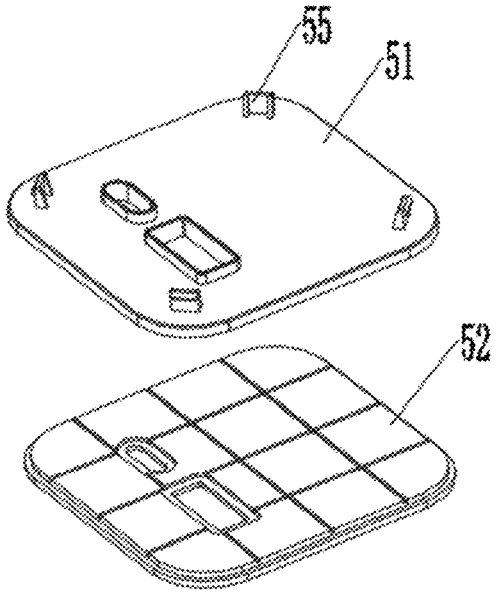
FIG. 12 is an exploded view of the shock absorbing end cover according to one embodiment.

Referring to FIGS. 10 and 12, in one embodiment, the inflator may further include a shock absorbing end cover 50 arranged at the bottom end of the housing 10. The shock absorbing end cover 50 may include an inner plate 51 and an outer plate 52. The inner plate 51 is arranged between the compressor body 21 and the outer plate 52. The inner plate 51 and the outer plate 52 can be connected to each other by snap-fit connection. The outer plate 52 is contactable with a support surface (e.g., ground, floor, etc.). The inner plate 51 can be made of hard rubber, and the outer plate 52 can be made of soft rubber. The inner plate 51 and the outer plate 52 can be integrally formed by injection molding.

By arranging the shock absorbing end cover 50 directly at the lower end of the housing 10 to avoid direct contact between the housing 10 and the support surface, it can effectively avoid frictional noise caused by vibration when the inflator is working, and can prevent the bottom of the housing 10 from being worn. In addition, since the shock absorbing end cover 50 is formed by injection-molding soft rubber and hard rubber together, it has good strength and integrity, which can not only facilitate the installation and fixing of the shock absorbing end cover 50, but also ensure the shock absorbing effect, have anti-slip effect and long service life.

Figure 11:
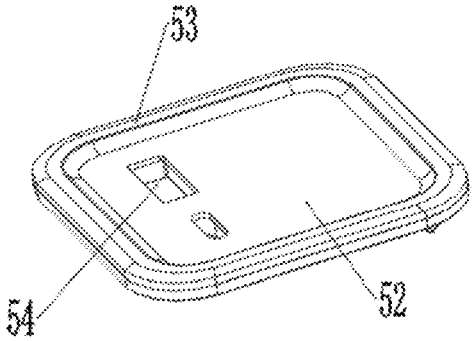
FIG. 11 is an isometric view of the shock absorbing end cover according to one embodiment.

Referring to FIGS. 11 and 12, in one embodiment, the outer plate 52 may include a protrusion 53 extending along a peripheral edge thereof, and the protrusion 53 protrudes from a surface of the outer plate 52 away from the inner plate 51. The outer panel 52 and the inner panel 51 can also be provided with a charging opening 54 corresponding to the charging port on the circuit board 34, and the charging opening 54 is located in the central area of the outer plate 52. In the embodiment, the protrusion 53 is located on the lower surface of the outer plate 52, and is integrally injection-molded with the outer plate 52 through a mold to directly contact the support surface, so that the contact area between the outer plate 52 and the support surface can be reduced, which can achieve the purpose of shock absorbing, anti-slip, and reducing appearance wear.

It should be noted that the present application does not specifically limit the shape of the protrusion 53, which can be designed according to the shape of the outer plate 52. The shape of the outer plate 52 can be designed according to the cross-sectional shape of the housing 10, and the cross-sectional shape of the housing 10 includes but not limited to square, circular and the like. In addition to the manner of arranging protrusions 53 around the periphery of the outer plate 52, other types of protrusions can be utilized. For example, multiple small protrusions can be distributed on the lower surface of the outer plate 52, which is not limited here.

Figure 13:
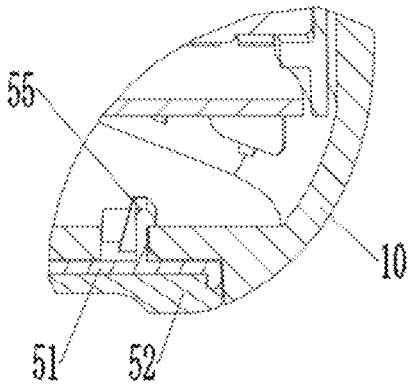
FIG. 13 is a portion of a planar cross-sectional view of the portable electric inflator.

Referring to FIG. 13, in one embodiment, the inner panel 51 is snap-connected with the housing 10. Specifically, the inner plate 51 is arranged with multiple hooks 55 along the circumferential direction, and the lower end of the housing 10 is correspondingly arranged with several through holes. The hooks 55 extend through the through holes into the housing 10 and hook the inner surface of the housing 10. The snap-fit connection can facilitate installation, disassembly and replacement of the shock absorbing end cover 50, which has the advantages of simple structure, convenient forming, and quick disassembly and assembly. In addition, the inner panel 51 is integrally injection-molded with the outer panel 52, which provides good strength and integrity. The inner panel 51 is snap-connected with the housing 10, which can not only facilitate the installation and fixing of the entire shock absorbing end cover 50, but also ensure the shock absorbing effect. Compared with the conventional approach of gluing a shock absorbing pad at the bottom of a conventional inflator, the installation is more stable, durable, and the appearance is more concise and aesthetic.

In addition to the snap-fit connection, other conventional connection techniques such as screws can also be used, which is not specifically limited in the present disclosure.

In one embodiment, there are four hooks 55 and they are distributed at the four corners of the inner plate 51. The present disclosure does not limit the number and distribution of the hooks 55, which can be adjusted according to actual needs.

Figure 2:
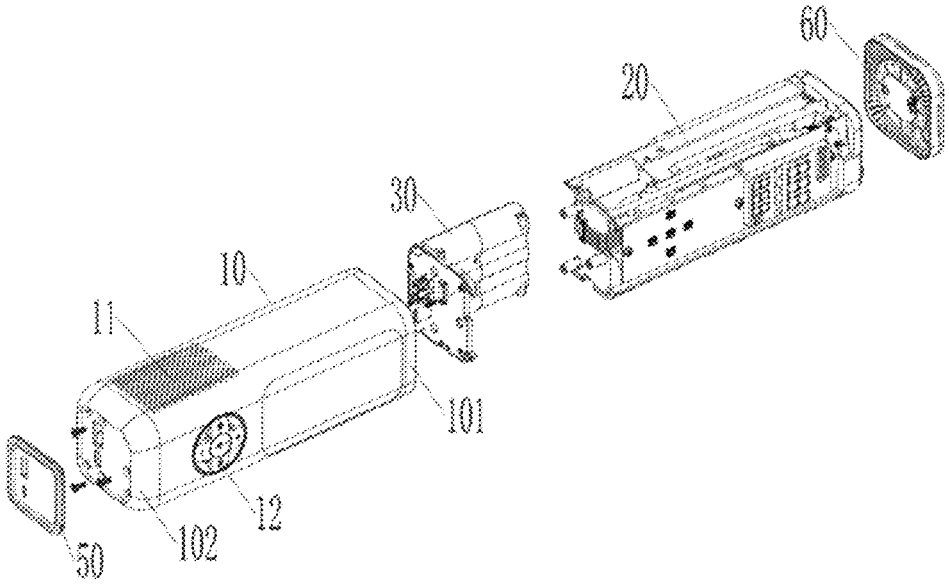
FIG. 2 is an exploded view of the portable electric inflator according to one embodiment.
Figure 14:
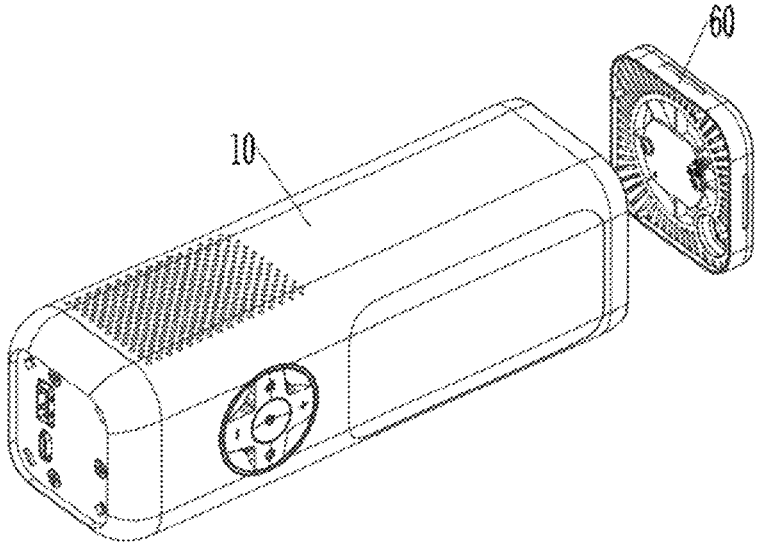
FIG. 14 is an exploded view of the portable electric inflator, showing a top cover detached from the housing of the portable electric inflator.

Referring to FIGS. 2 and 14, a top cover 60 is arranged on the upper end of the housing 10, and an indicator light is arranged on the top cover 60. The top cover 60 is to prevent the compressor 20 from being directly exposed to the external environment, and the indicator light is to indicate the working status and charging status of the inflator. The top cover 60 can be connected to the housing 10 through snap-fit connection, screws, etc., which is not limited in the present disclosure.

In one embodiment, the top cover 60 is snap-connected with the housing 10. For example, four hooks are arranged on the top cover 60, and four through holes matching the books are defined in the housing 10. The hooks correspond to the through holes one by one and are engaged with the through holes, respectively. It should be noted that the present disclosure does not impose any limitation on the number of the hooks.

In one embodiment, the top cover 60 is provided with multiple slots to facilitate the heat dissipation of the compressor 20 and prevent the temperature inside the housing 10 from being too high that can result in failure of the inflator.

In sum, the present disclosure provides a portable electric inflator. By forming a receiving space 40 between the pump 213 and the housing 10 to accommodate the L-shaped battery assembly 30, the battery assembly 30 occupies a small space, which makes full use of the space inside the housing 10, thereby improving the structural compactness of the entire inflator, reducing the size of the inflator, and facilitating storage and portability.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A portable electric inflator comprising:

a housing comprising an upper end and a lower end, and defining a receiving chamber that extends from the upper end to the lower end;

an air compressor comprising a compressor body that comprises a motor, a transmitting mechanism, and a pump that are received in the receiving chamber and sequentially arranged in an order from the upper end to the lower end, wherein a receiving space is formed between the pump and the housing;

a battery assembly arranged in the receiving chamber near the lower end, the battery assembly comprising:

a battery retainer received in the receiving space;

at least two battery cells arranged side by side in the battery retainer;

a support member extending from one end of the battery retainer adjacent to the lower end, the support member perpendicular to a lengthwise direction of the battery retainer; and a circuit board fixed to the support member and electrically connected with the at least two battery cells.

2. The portable electric inflator of claim 1, wherein the battery retainer protrudes from one side surface of the support member, and the support member and the battery retainer form an L-shaped structure.

3. The portable electric inflator of claim 1, wherein the battery retainer comprises a first retainer and a second retainer that are connected to each other, each of the first retainer and the second retainer is hollow, the first retainer and the second retainer corporately define at least two battery receiving chambers to respectively receive the at least two battery cells.

4. The portable electric inflator of claim 3, wherein the at least two battery receiving chambers extend along a lengthwise direction of the housing, a guide groove is formed in an external surface of the battery retainer between each two adjacent ones of the at least two battery receiving chambers, at least one guide ridge protrudes from an inner surface of the housing, the at least one guide ridge is fit in one of the guide grooves, and slides along the one of the guide grooves when the battery retainer is inserted into the receiving space.

5. The portable electric inflator of claim 1, wherein the air compressor further comprises a first casing, a second casing, a control circuit board, a discharge hose, and a sensor hose, the compressor body is arranged between the first casing and the second casing, the first casing and the second casing each define an accommodating groove for respectively receiving the sensor hose and the discharge hose, the sensor hose and the discharge hose are connected with the pump, and the control board is fixed to the first casing.

6. The portable electric inflator of claim 5, wherein the support member defines a plurality of positioning holes, and a plurality of positioning posts are arranged on the first casing and the second casing and are respectively received in the plurality of positioning holes.

7. The portable electric inflator of claim 6, wherein the plurality of positioning posts is configured in one of the following manners that allows the battery retainer to be inserted into the receiving space only in a predetermined angle:

each of the plurality of positioning posts has an irregular cross section;

the cross sections of the positioning posts are different in size; and the cross sections of the positioning posts are different in shape.

8. The portable electric inflator of claim 6, wherein the compressor body comprises a plurality of protruding posts that are inserted into the first casing and the second casing, and the protruding posts are covered with shock-absorbing pads.

9. The portable electric inflator of claim 1, further comprising a shock absorbing end cover arranged at the bottom end of the housing, wherein the shock absorbing end cover comprises an inner plate and an outer plate, the inner plate is arranged between the compressor body and the outer plate, the outer plate is contactable with a support surface, the inner plate is made of hard rubber, the outer plate is made of soft rubber, and the inner plate and the outer plate are formed integrally.

10. The portable electric inflator of claim 9, wherein the outer plate comprises a protrusion extending along a peripheral edge thereof, and the protrusion protrudes from a surface of the outer plate away from the inner plate.

* * * * *